US006217287B1

(12) United States Patent
Monk et al.

(10) Patent No.: US 6,217,287 B1
(45) **Date of Patent: *Apr. 17, 2001**

(54) VARIABLE CAPACITY COMPRESSOR HAVING ADJUSTABLE CRANKPIN THROW STRUCTURE

(75) Inventors: David T. Monk; Joe T. Hill, both of Bristol, VA (US); Philip C. Wagner, Bristol, TN (US); Joseph F. Loprete, Bristol, TN (US); Michael R. Young, Bristol, TN (US); Charles A. Singletary, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/235,288

(22) Filed: Jan. 22, 1999

Related U.S. Application Data

(63) Continuation of application No. 09/013,154, filed on Jan. 26, 1998, now Pat. No. 6,099,259.

(51) Int. Cl.[7] ..... F04B 49/06
(52) U.S. Cl. ..... 417/45; 417/221; 417/326
(58) Field of Search ..... 417/45, 221, 326

(56) References Cited

U.S. PATENT DOCUMENTS

| | | | |
|---|---|---|---|
| 4,031,778 | 6/1977 | Fazekas . | |
| 4,236,874 | 12/1980 | Sisk . | |
| 4,242,626 | 12/1980 | Gross . | |
| 4,245,966 | 1/1981 | Riffe . | |
| 4,248,053 | 2/1981 | Sisk . | |
| 4,396,359 | 8/1983 | Kropiwnicki . | |
| 4,472,670 | 9/1984 | Stanley . | |
| 4,479,419 | 10/1984 | Wolfe . | |
| 4,494,447 | 1/1985 | Sisk . | |
| 4,503,371 | 3/1985 | Sugita . | |
| 4,566,289 | 1/1986 | Iizuka . | |
| 4,598,764 | 7/1986 | Beckey . | |
| 4,687,982 | 8/1987 | Palaniappan . | |
| 4,718,247 | 1/1988 | Kobayashi et al. . | |
| 4,767,293 | 8/1988 | Caillat et al. . | |
| 4,838,769 | 6/1989 | Gannaway . | |
| 4,879,502 | 11/1989 | Endo et al. . | |
| 4,963,075 | 10/1990 | Albertson et al. . | |
| 5,070,932 | 12/1991 | Vlasak . | |
| 5,080,130 | 1/1992 | Terwilliger et al. . | |
| 5,106,278 | 4/1993 | Terwilliger et al. . | |
| 5,129,792 | 7/1992 | Abousabha . | |
| 5,201,640 | 4/1993 | Heinzelmann et al. . | |
| 5,203,857 | 4/1993 | Terwilliger et al. . | |
| 5,252,905 | 10/1993 | Wills et al. . | |
| 5,592,059 | 1/1997 | Archer . | |
| 5,619,860 | 4/1997 | Yuji et al. . | |
| 5,780,990 | 7/1998 | Weber . | |
| 6,092,993 * | 7/2000 | Young et al. | 417/53 |

FOREIGN PATENT DOCUMENTS

| | | |
|---|---|---|
| 3138812 | 4/1983 | (DE) . |
| 4322223 | 1/1995 | (DE) . |
| 0 547351 A2 | 6/1993 | (EP) . |

* cited by examiner

*Primary Examiner*—Charles G. Freay
*Assistant Examiner*—Ehud Gartenberg
(74) *Attorney, Agent, or Firm*—Finnegan, Henderson, Farabow, Garrett & Dunner, L.L.P.

(57) ABSTRACT

A two-stage reciprocating compressor is provided. The compressor includes a reversible motor that rotates a crankshaft. The crankshaft is connected to a piston by a mechanical system. The mechanical system drives the piston at a full stroke between a bottom position and a top dead center position when the motor is operated in a forward direction. The mechanical system drives the piston at a reduced stroke between an intermediate position and the top dead center position when the motor is operated in the reverse direction. The compressor also includes a control for selectively operating the motor in either the forward direction at a first preselected, fixed speed or in the reverse direction at a second preselected fixed speed.

13 Claims, 16 Drawing Sheets

VARIABLE CAPACITY COMPRESSOR HAVING ADJUSTABLE CRANKPIN THROW STRUCTURE

RELATED APPLICATIONS

This is a continuation of application Ser. No. 09/013,154, filed Jan. 26, 1998 now U.S. Pat. No. 6,099,259 all of which are incorporated herein by reference.

BACKGROUND OF THE INVENTION

The present invention is concerned with variable capacity compressors, vacuum or other pumps or machines, and particularly those reciprocating piston compressors used in refrigeration, air conditioning systems or heat pumps or the like, including machines such as scotch yoke compressors of U.S. Pat. No. 4,838,769, wherein it is desirable to vary the compressor output, i.e., compressor capacity modulation, in accordance with cooling load requirements. Such modulation allows large gains in efficiency while normally providing reduced sound, improved reliability, and improved creature comforts including one or more of reduced air noise, better de-humidification, warmer air in heat pump mode, or the like.

The efficiency gains resulting from a compressor with capacity modulation are beneficial in a variety of commercial applications. For example, most residential refrigerators currently utilize a single capacity compressor and cycle the compressor on and off to maintain a certain temperature within the cabinet of the refrigerator. During normal operation, the temperature of the refrigerator increases due to the warmer ambient air surrounding the refrigerator or when the refrigerator door is opened or a load of perishables having a temperature greater than that of the cabinet is introduced to the refrigerator. If the temperature exceeds a preset limit, the compressor is activated to cool the cabinet of the refrigerator. To account for the higher load conditions when the door is opened or perishables are introduced to the cabinet, the cooling capacity of the compressor is necessarily greater than the minimum required to maintain a particular temperature in the ambient conditions. With this design, the compressor undergoes multiple starts and stops to respond to varying load conditions. The high number of starts and stops will shorten the life of the compressor. Additionally, operating the compressor at full capacity during periods of minimal load is inefficient.

One approach to achieving modulation of a compressor has been to switch the stroke length, i.e., stroke, of one or more of the reciprocating pistons whereby the volumetric capacity of the cylinder is changed. In these compressors the reciprocating motion of the piston is effected by the orbiting of a crankpin, i.e., crankshaft eccentric, which is attached to the piston by a connecting rod means which has a bearing in which the eccentric is rotatably mounted.

A proposed mechanism in the published art for switching stroke is the use of a cam bushing mounted on the crankshaft eccentric, which bushing when rotated on the eccentric will shift the orbit axis of the connecting rod bearing radially and parallelly with respect to the crankshaft rotational axis and thus reduce or enlarge the rod bearing orbit radius. This, in turn, changes the piston stroke accordingly. In such cam action mechanism the piston at the reduced stroke does not attain full or primary stroke top-dead-center (TDC) positioning within the cylinder. This design diminishes compression and permits considerable reexpansion of the only partially compressed refrigerant. The efficiency of the compressor is thus markedly compromised.

Certain prior art cam mechanisms are shown and described in U.S. Pat. Nos. 4,479,419; 4,236,874; 4,494,447; 4,245,966; and 4,248,053, the disclosures of which with respect to general compressor construction and also with respect to particular structures of cylinder, piston, crankshaft, crankpin and throw shifting mechanisms are hereby incorporated herein by reference in their entirety. With respect to these patents the crankpin journal is comprised of an inner and one or more outer eccentrically configured journals, the inner journal being the outer face of the crankpin or eccentric, and the outer journal(s) being termed "eccentric cams or rings" in these patents. The outer journals are rotatably mounted or stacked on the inner journal. The bearing of the connecting rod is rotatably mounted on the outer face of the outermost journal. In these patents, all journal and bearing surfaces of the coupling structure or power transmission train of the shiftable throw piston, from the crankshaft to the connecting rod are conventionally circular.

Referring particularly to the U.S. Pat. No. 4,245,966 patent, a TDC position of the piston is said to be achieved thru the use of two eccentric rings which are provided with stops to orient the cams, in the hope of achieving the TDC position. This structure is very complex, expensive, and difficult to manufacture and to assemble, in a commercial sense. Further, as stated in this patent at col. 4 lines 32–38, the operability of these two eccentrics to attain TDC is essentially by chance and is just as likely to result in a piston-valve plate crash.

OBJECTS OF THE INVENTION

An object of the present invention is to provide an improved coupling structure for a crankpin throw shifting mechanism for a single or multi-cylinder compressor wherein the piston always achieves primary TDC position regardless of the degree of stroke change.

Another object is to provide improved commercial applications of single or multiple compressors that include the improved coupling structure. These and other objects will become apparent from the description and claims of the invention, presented below.

SUMMARY OF THE INVENTION

Accordingly, one aspect of the present invention is directed to a unique, simple and reliable coupling structure for functionally connecting a connecting rod bearing and a crankpin. This structure is adapted to change the primary stroke of a piston while always effecting primary top dead center positioning of said piston on its up-stroke regardless of the stroke change.

In accordance with another aspect of the present invention, as embodied and broadly described herein, the invention is directed to a two stage reciprocating compressor. The compressor includes a reversible motor for rotating in a forward and a reverse direction and a block with a single cylinder and associated single compression chamber and single piston. A mechanical system is provided between the motor and the single piston for driving the piston at a full stroke between a bottom position and a top dead center position when the motor is operated in the forward direction and for driving the piston at a reduced stroke between an intermediate position and the top dead center position when the motor is operated in the reverse direction. There is further provided a control for selectively operating said motor either in the forward direction at a first preselected, fixed speed or in the reverse direction at a second preselected, fixed speed.

According to another aspect, the invention is directed to a refrigerator appliance that includes a two-stage reciprocating compressor that has an electrical motor and a single cylinder with an associated single compression chamber and single piston. The compressor is operable at either at a first stage with a first capacity or at a second stage with a second, reduced capacity.

In another aspect, the invention is directed to a heating, ventilating, and air conditioning ("HVAC") system for conditioning air within an enclosure. The HVAC system includes a two-stage reciprocating compressor that has an electrical motor and a single cylinder with an associated single compression chamber and single piston. The compressor is operable at either at a first stage with a first capacity or at a second stage with a second, reduced capacity.

In still another aspect, the invention is directed to a power system for a motordriven component of a heating and/or air conditioning system ("HVAC"). The power system includes an induction motor with a start and a run winding and a circuit for controlling the motor to rotate in a forward direction in a first stage and in a reverse direction in a second stage. The circuit design includes a first terminal for connection to line power, a second terminal for connecting to the line power, a capacitor, and a switching device that places the capacitor in series with the start winding and utilizes the run winding as the main winding when the motor is in the first stage and that places the capacitor in series with the start winding and utilizes the start winding as the main winding when the motor is in the second stage.

As explained in more detail below, the present invention provides a structurally simple coupling mechanism which can be manufactured to give any desired compressor capacity shift. The coupling structure of the invention can be applied to give different strokes for two or more pistons of multi-cylinder compressors and provide a wide range of desired variations in compressor capacity without reducing compressor efficiency thru significant volume clearance, i.e., clearance between the piston top and valve plate at TDC. The invention also includes a motor control circuit that can be used to advantage with the disclosed compressor to achieve markedly improved overall efficiency of operation.

It is to be understood that both the foregoing general description and the following detailed description are exemplary and explanatory only and are not restrictive of the invention, as claimed.

BRIEF DESCRIPTION OF THE DRAWINGS

The invention will be understood further from the drawings herein which are not drawn to scale and in which certain structural portions are exaggerated in dimension for clarity, and from the following description wherein.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

The present invention is directed to improved two stage, reversible reciprocating compressors and the application of such compressors to cooling systems including, but not limited to, both refrigerator appliances and heating, ventilating and air conditioning ("HVAC") systems. The compressors include a mechanical system that alters the stroke of at least one piston, when the direction of motor rotation is reversed. When the motor is operating in a forward direction, the piston travels through a full stroke within the respective cylinder. When the motor is reversed, the piston travels through a reduced stroke within the cylinder. The mechanical system preferably ensures that the piston reaches the top dead center positioning within the cylinder in both the full stroke and reduced stroke operation modes. In the exemplary embodiments, the mechanical system is illustrated in compressors having a single compression chamber and piston. However, the present invention contemplates that the mechanical system may also be used in compressors having multiple compression chambers and pistons.

Figure 1:
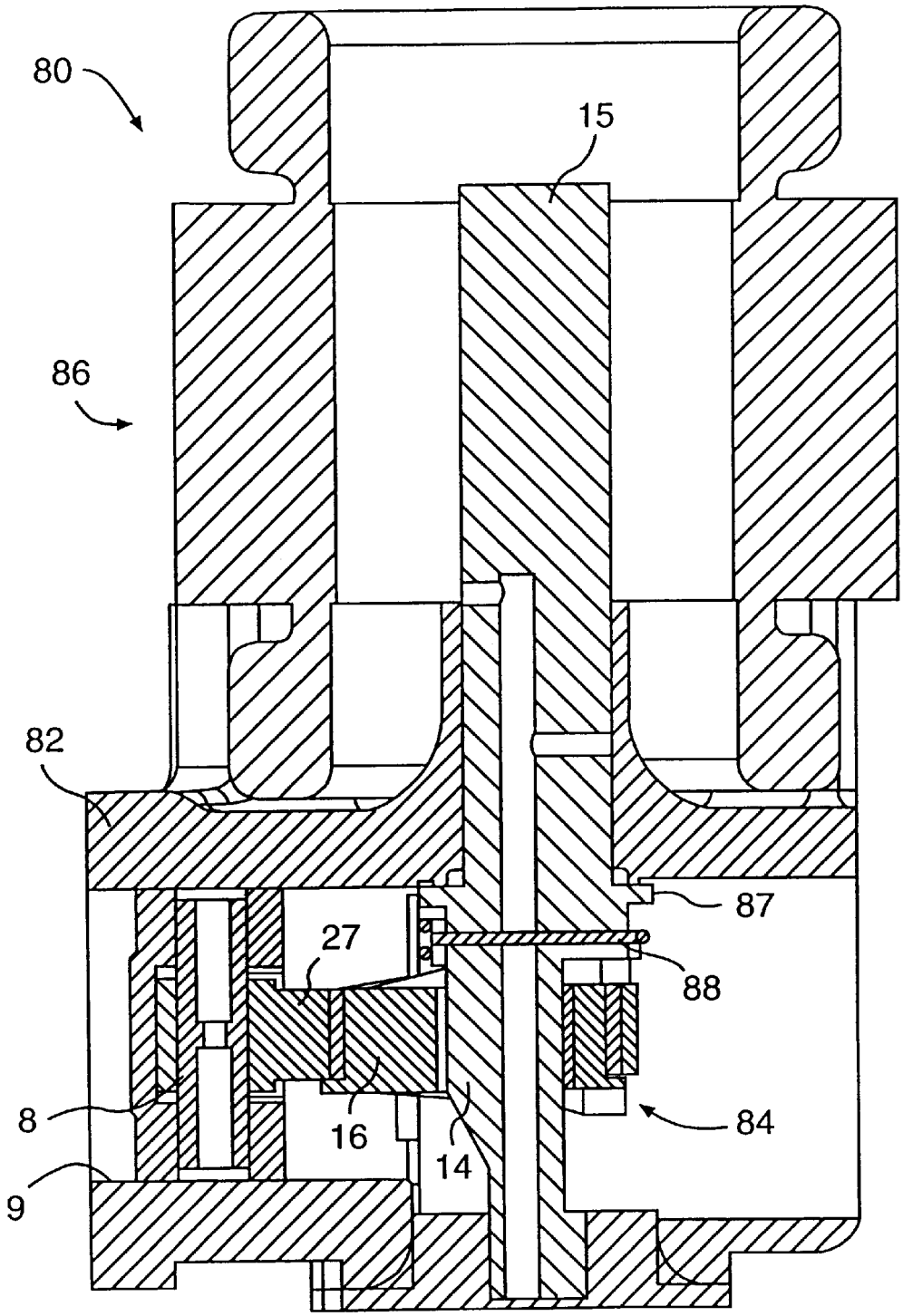
FIG. 1 is a sectional view of a two-stage reciprocating compressor for a heating, ventilating, and air conditioning ("HVAC") system, generally illustrating a coupling structure according to the present invention.

One exemplary embodiment of a two-stage reciprocating compressor is illustrated in FIG. 1 and is generally designated as reference number 80. As shown, compressor 80 includes a block 82 formed with a cylinder 9. Cylinder 9 slidably receives a piston 8 for reciprocal motion within the cylinder.

Piston 8 is connected to a rotatable crankshaft 15 that is also mounted within block 82. A reversible motor 86 selectively rotates crankshaft 15 in either a forward direction or a reverse direction to thereby effect motion of piston 8.

In accordance with the present invention, a mechanical system is provided to connect the piston and the rotatable crankshaft. The mechanical system drives the piston through a full stroke between a bottom position and a top dead center position when the motor is operated in the forward direction. The mechanical system drives the piston through a half stroke between an intermediate position and the top dead center position when the motor is operated in the reverse direction.

Figure 3A:
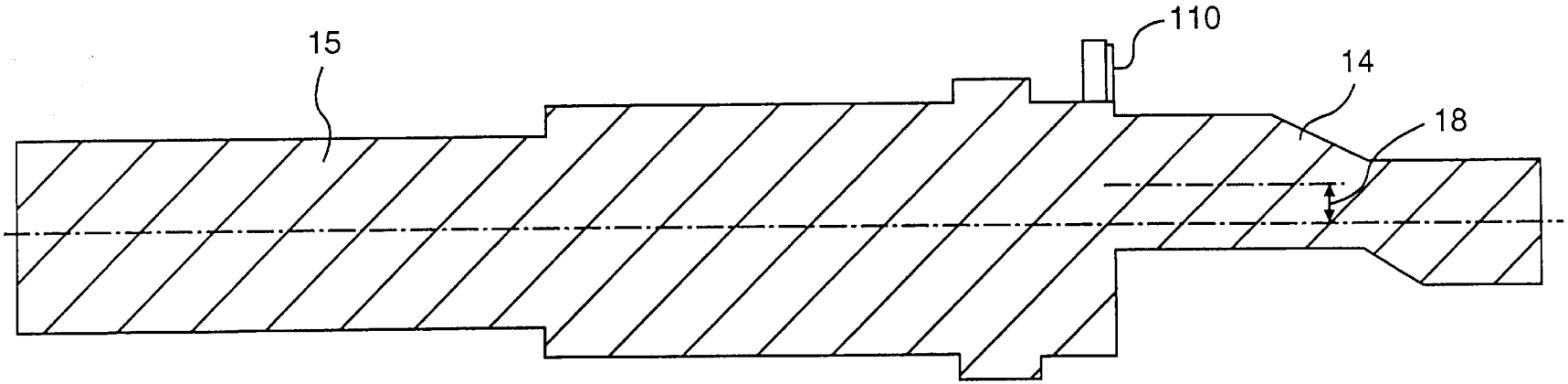
FIG. 3*a* is a cross sectional view of a crankshaft according to the present invention.
Figure 3B:
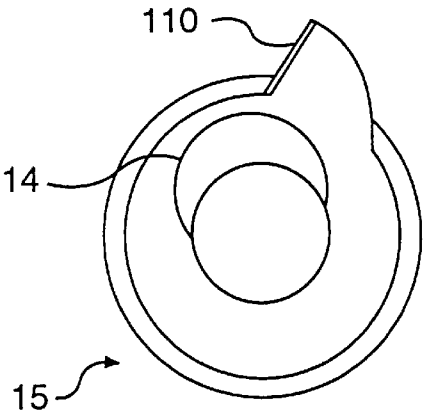
FIG. 3*b* is an end view of the crankshaft of FIG. 3*a;*
Figure 4C:
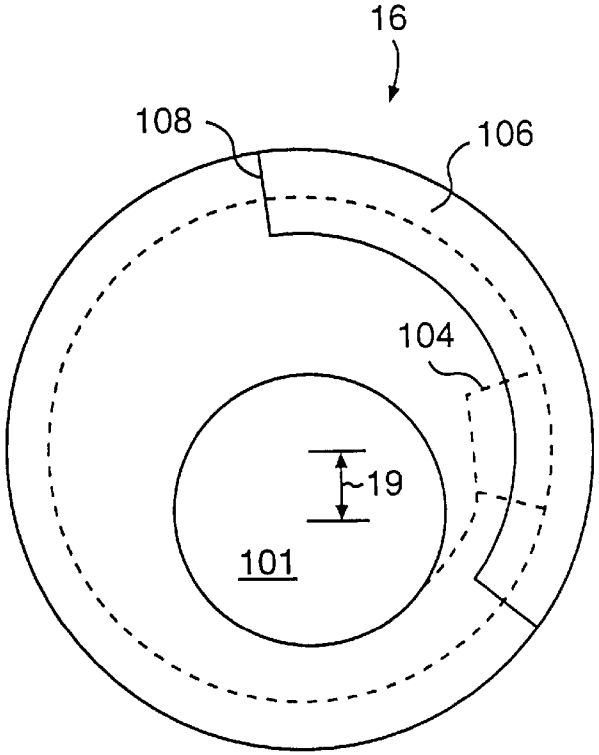
FIG. 4*c* is a second perspective view of the eccentric cam of FIG. 4*a;*
Figure 4B:
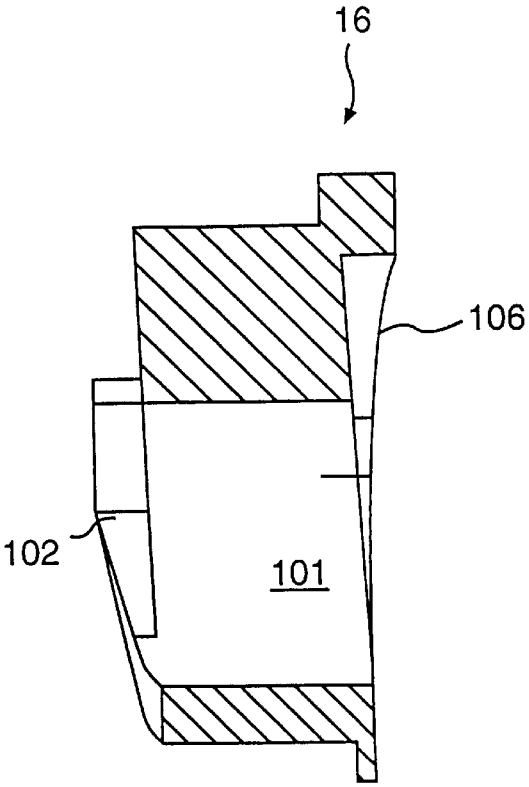
FIG. 4*b* is a cross sectional view of the eccentric cam of FIG. 4*a;*
Figure 4A:
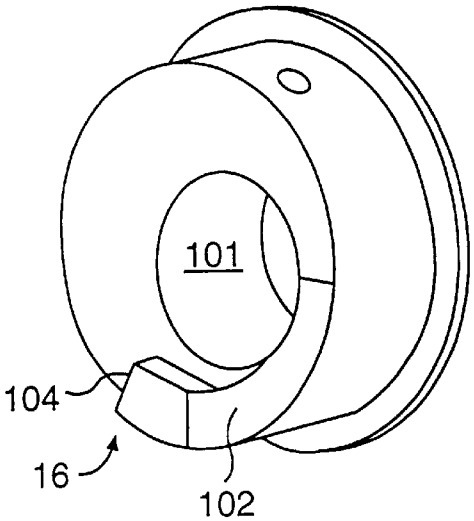
FIG. 4*a* is a perspective view of an eccentric cam according to the present invention.
Figure 5A:
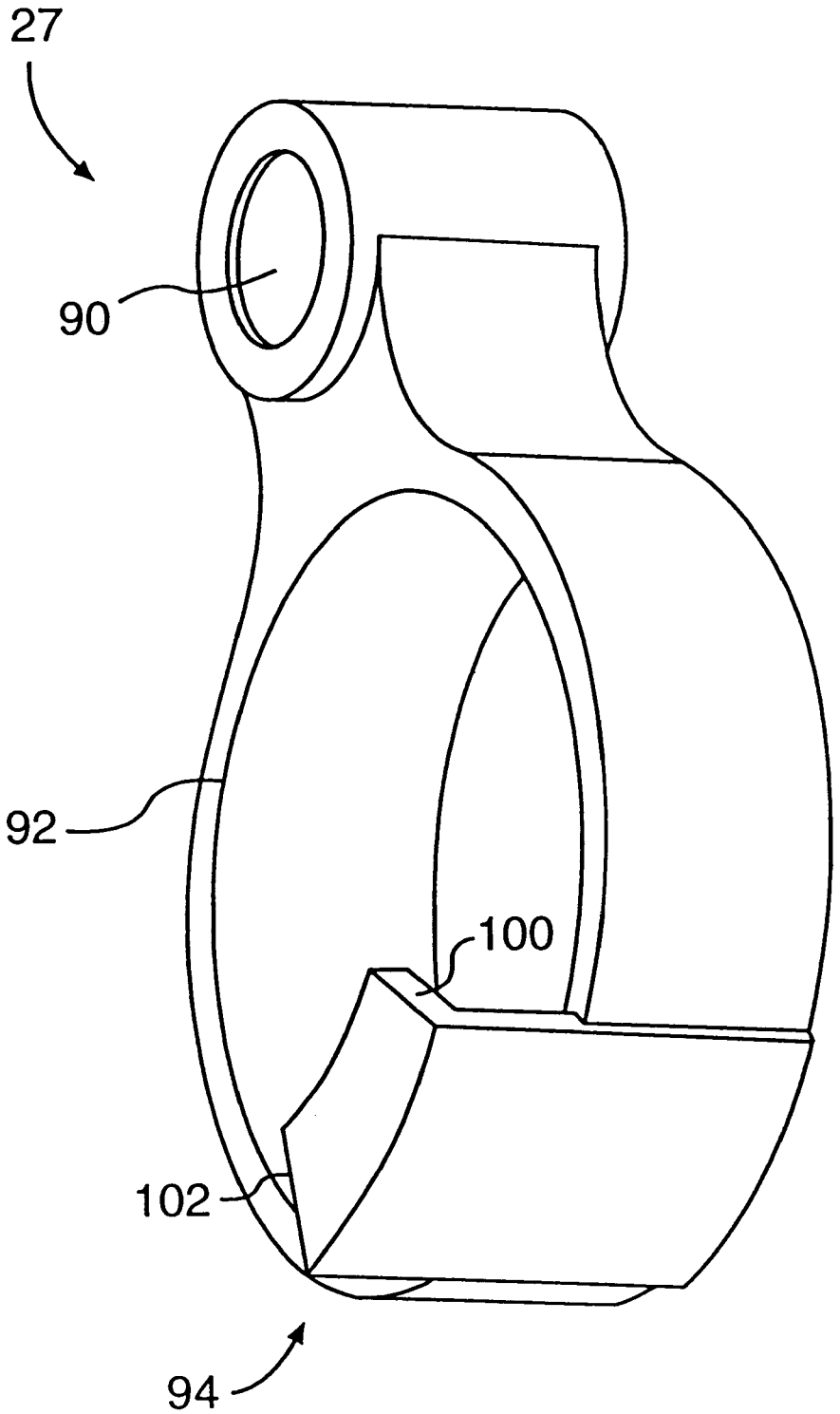
FIG. 5*a* is a perspective view of a connecting rod according to the present invention.
Figure 5C:
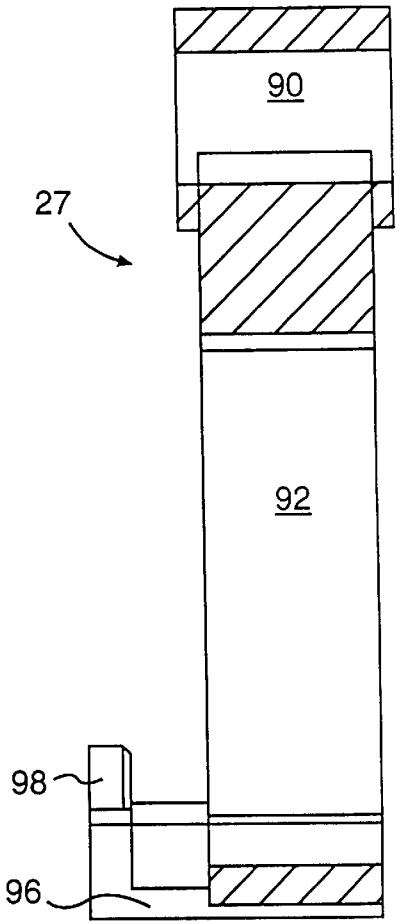
FIG. 5*c* is a cross-sectional view of the connecting rod of FIG. 5*a;*
Figure 5B:
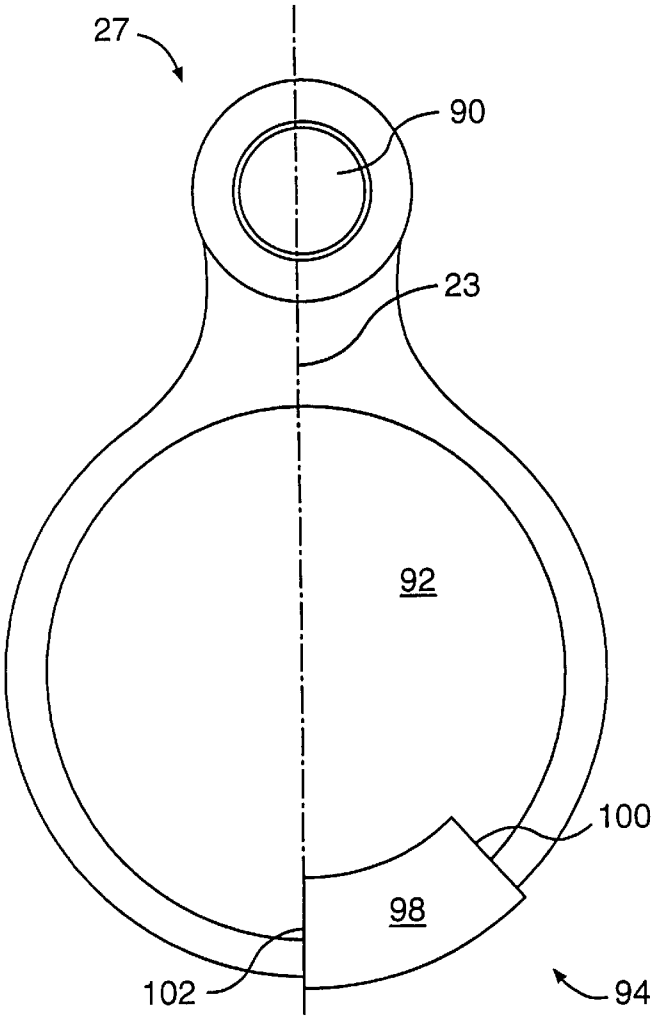
FIG. 5*b* is a front plan view of the connecting rod of FIG. 5*a;*

As illustrated in FIG. 1, mechanical system 84 includes an eccentric crankpin 14, an eccentric cam 16, and a connecting rod 27. As illustrated in FIGS. 3*a* and 3*b*, eccentric crankpin 14 is formed as part of crankshaft 15 and has an eccentricity 18. As illustrated in FIGS. 4*a*–4*c*, eccentric cam 16 is includes an opening 101 in which crankpin 14 is rotatably disposed and has an eccentricity 19. As shown in FIGS. 5*a*–5*c*, crankpin 27 includes an opening 92 in which eccentric cam 16 is rotatably disposed.

Figure 2A:
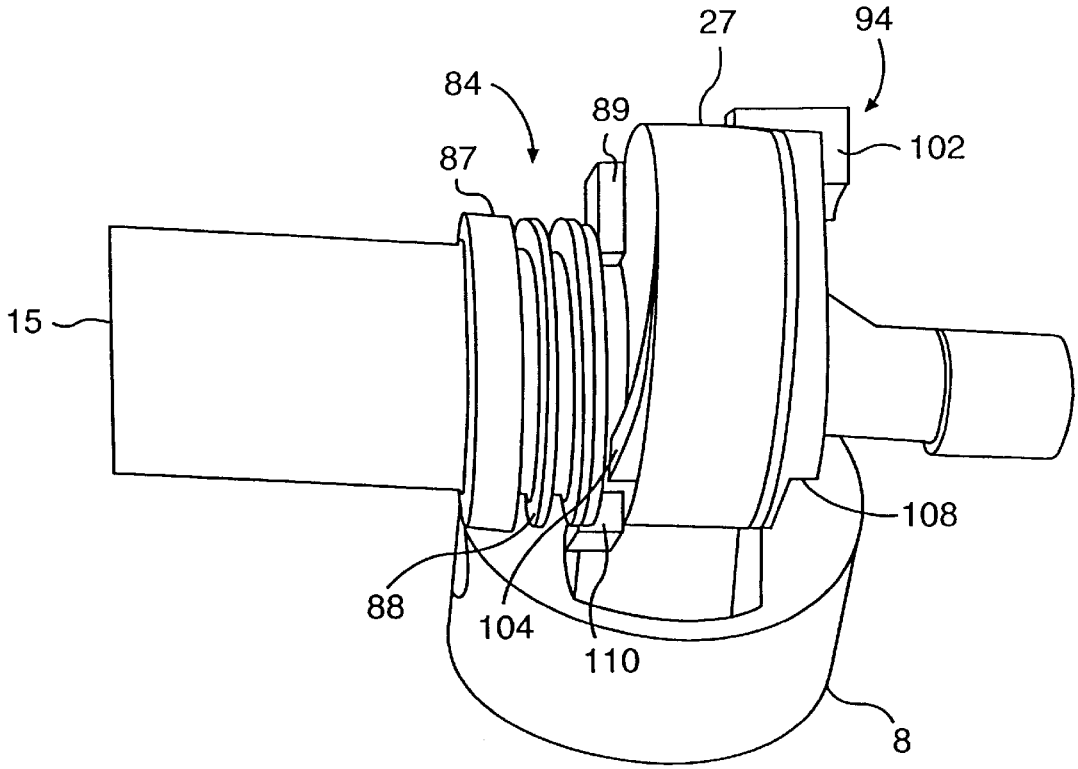
FIGS. 2*a*–2*b* are perspective views of a mechanical system for linking a reversible motor to a piston in accordance with the present invention.
Figure 2B:
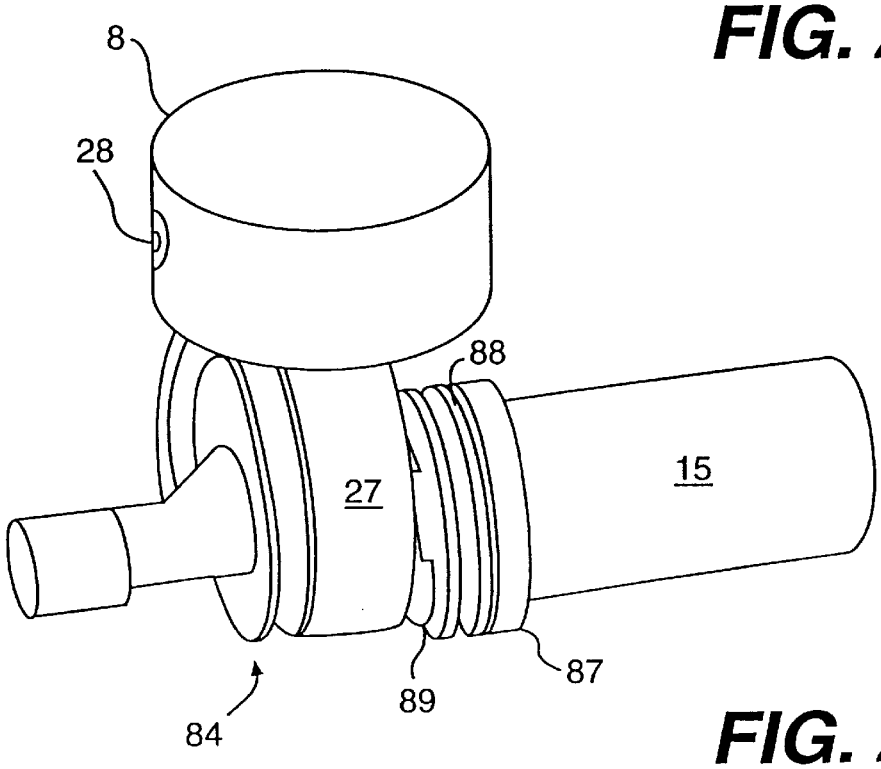

As shown in FIGS. 2*a* and 2*b*, connecting rod 27 is connected to piston 8 by a wrist pin 28. This connection allows connecting rod 27 to pivot with respect to piston 8. It is contemplated that other, similar connecting devices will be readily apparent to one skilled in the art.

The mechanical system also includes a first stop mechanism for restricting the relative rotation of the eccentric cam about the crankpin when the motor is rotating the crankshaft in the forward direction and a second stop mechanism for restricting the relative rotation of the eccentric cam with respect to the connecting rod when the motor is rotating the crankshaft in the reverse direction. Thus, when the motor is running in the forward direction, the eccentric cam is fixed to the crankpin at a first position by the first stop mechanism and the eccentric cam rotates with respect to the connecting rod. When the rotational direction of the motor is reversed, the eccentric cam rotates out of the first position to a second position where the second stop mechanism fixes the cam to the connecting rod. In the preferred embodiment, at the second position the crankpin rotates within the eccentric cam.

In one exemplary embodiment and as illustrated in FIGS. 3*a* and 3*b*, the first stop mechanism includes a stop 110 positioned on crankshaft 15 adjacent eccentric crankpin 14. As illustrated in FIGS. 4*a*–4*c*, eccentric cam 16 includes a first sloping projection 102 that ends in a face 104. When crankshaft 15 is rotated in the forward direction stop 110 engages face 104 so that eccentric cam 16 is fixed with respect to eccentric crankpin 14. When crankshaft 15 is rotated in the reverse direction, stop 110 rides along sloping projection 102, causing eccentric cam 16 to slide along crankpin 14, until stop 110 eventually drops over face 104. Thus, when crankshaft 15 rotates in the reverse direction, eccentric crankpin 14 is free to rotate within eccentric cam 16.

Figure 13A:
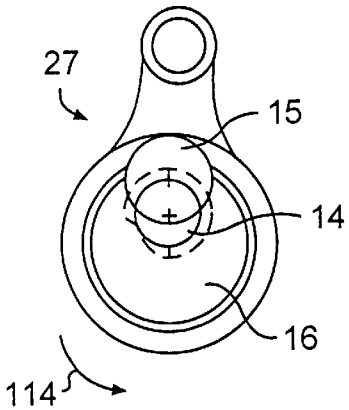
FIGS. 13*a*–13*e* are a series of front views of a mechanical system according to the present invention, illustrating the operation of a mechanical system in a full stroke mode.
Figure 13B:
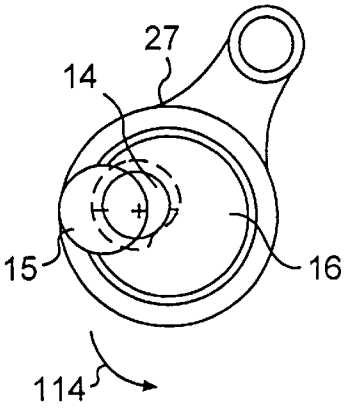
Figure 13C:
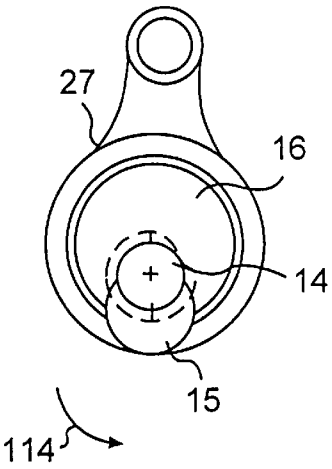
Figure 13D:
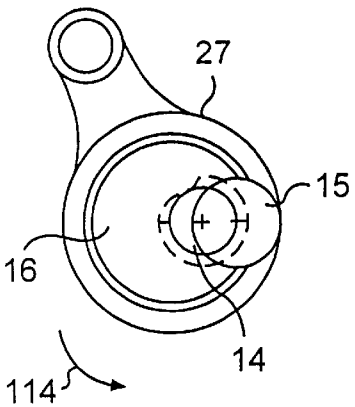
Figure 13E:
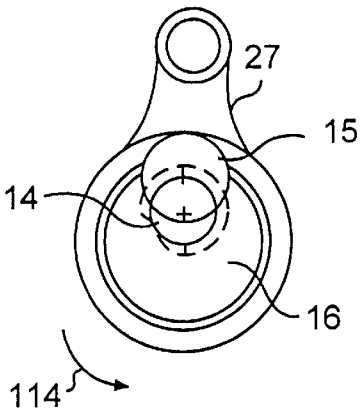

Preferably, the components of the first stop mechanism are disposed on crankshaft 15 and eccentric cam 16 so that when crankshaft 15 is rotated in the first direction and the eccentric cam is fixed with respect to the crankpin, the eccentricity 18 of crankpin 14 aligns with eccentricity 19 of eccentric cam 16. FIGS. 13*a*–13*e* illustrate the operation of the coupling structure in the full stroke mode. Crankpin 15 is rotated in the first direction as indicated by arrow 114. As shown in FIG. 13*a*, when crankpin 14 is at the bottom of its rotation, the combined eccentricity of cam 16 and crankpin 14 move connecting rod 27 and connected piston to the bottom position. Similarly, as shown in FIG. 13*c*, when crankpin 14 is at the top of its rotation, the combined eccentricity of cam 16 and crankpin 14 move connecting rod 27 and connected piston to the top dead center position.

As illustrated in FIGS. 4*a*–4*c*, the second stop mechanism includes a second sloping projection 106 on eccentric cam 16, preferably on the opposite side of the eccentric cam from first sloping projection 102. Second sloping projection 106 ends in face 108. As shown in FIGS. 5*a*–5*c*, connecting rod 27 includes a stop 94 having two support members 96 and 98 that form an L-shape extending away from and over opening 92. Support member 98 includes two faces 100 and 102.

When crankshaft 15 is rotated in the forward direction, the first stop mechanism fixes eccentric cam 16 to crankpin 14 and the eccentric cam rotates within connecting rod 27. As eccentric cam 16 rotates within connecting rod 27, face 102 of stop 94 rides along sloping projection 106, thereby causing eccentric cam 16 to slide along crankpin 14. Eventually face 102 of stop 94 moves over face 108 of sloping projection 106. When the direction of rotation is reversed, the first stop mechanism disengages and crankpin 14 rotates freely within eccentric cam 16. The eccentric cam will rotate in the reverse direction with respect to connecting rod 27 until face 108 of sloping projection 106 on eccentric cam 16 engages stop 94 on connecting rod 27. This engagement will restrict the rotation of the eccentric cam with respect to the connecting rod when the crankshaft is rotated in the reverse direction.

Preferably, as illustrated in FIGS. 2*a* and 2*b*, a spring 88 and a collar 89 are positioned on crankshaft 15. Spring 88 and collar 89 rotate with crankshaft 15. Spring 88 acts through collar 89 to bias eccentric cam 16 along crankpin 14. The action of spring ensures that faces 104 and 108 on eccentric cam 16 will align with and engage stops 110 and 94 on crankshaft 15 and connecting rod 27, respectively when the rotational direction of crankshaft 15 is switched. It is contemplated that the sizing and tolerances of the components of the mechanical system may be such that spring 88 and collar 89 may be omitted and the acceleration forces generated when the motor is reversed will ensure that the first and second stop mechanisms will still engage the respective stops on the connecting rod and crankshaft.

FIGS. 14*a*–14*e* illustrate the operation of the coupling structure in the reduced stroke mode. Crankpin 15 is rotated in the reverse direction as indicated by arrow 115. It should be noted that FIGS. 14*a*–14*e* depict the opposite side of the coupling structure from FIGS. 13*a*–13*e*. Thus, while the figures depict the rotation of the crankpin 15 as counterclockwise in both sets of figures, the actual direction of the crankpin is in the opposite direction.

Figure 14A:
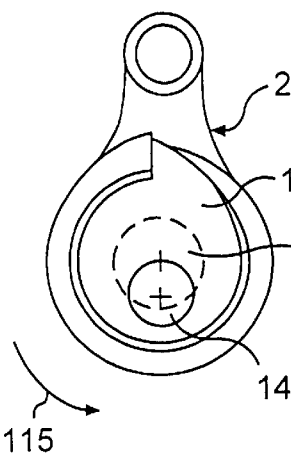
FIGS. 14*a*–14*e* are a series of rear views of a mechanical system according to the present invention, illustrating the operation of the mechanical system in a half stroke mode.
Figure 14B:
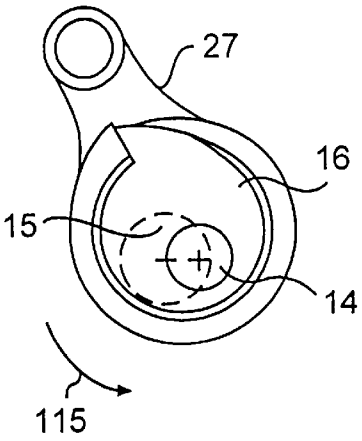
Figure 14C:
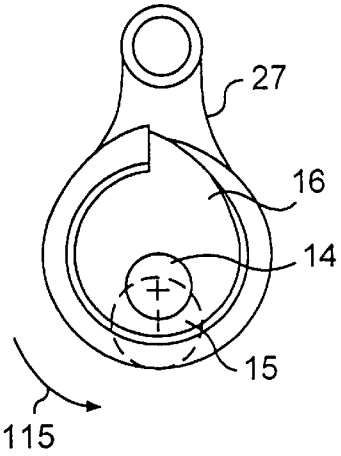
Figure 14D:
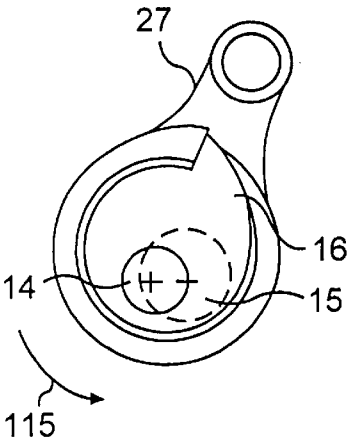
Figure 14E:
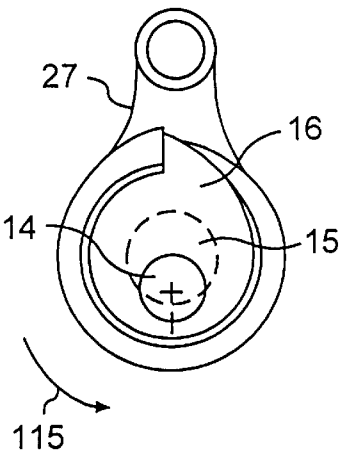

Preferably, the components of the second stop mechanism are disposed on eccentric cam 16 and connecting rod 27 so that when crankshaft 15 is rotated in the reverse direction the eccentricity 18 of eccentric cam 16 aligns with an axis 23 of connecting rod 27. Thus, the eccentricity 19 of the crankpin will only align with eccentricityl8 of the eccentric cam when crankpinl4 is at the top of its rotation. As shown in FIG. 14*c*, this alignment results in the piston reaching the top dead center position when operating in the half stroke mode. As shown in FIGS. 14*a* and 14*e*, when crankpin 14 is at the bottom of its rotation, the eccentricity of cam 16 is opposite the eccentricity of crankpin 14. Thus, the piston only moves to an intermediate position, and not to the bottom position. It should be noted that the stroke length of the reduced stroke operation may be altered by varying the eccentricities 18 and 19 of the eccentric cam and crankpin, respectively.

Figure 6A:
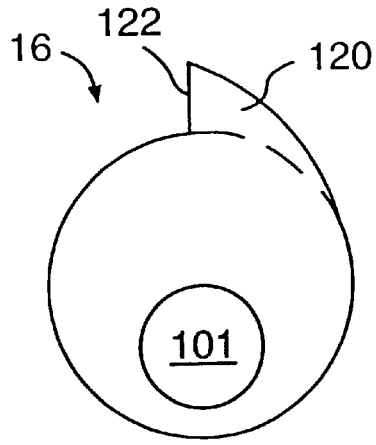
FIG. 6*a* is a front plan view of a second embodiment of an eccentric cam.
Figure 6B:
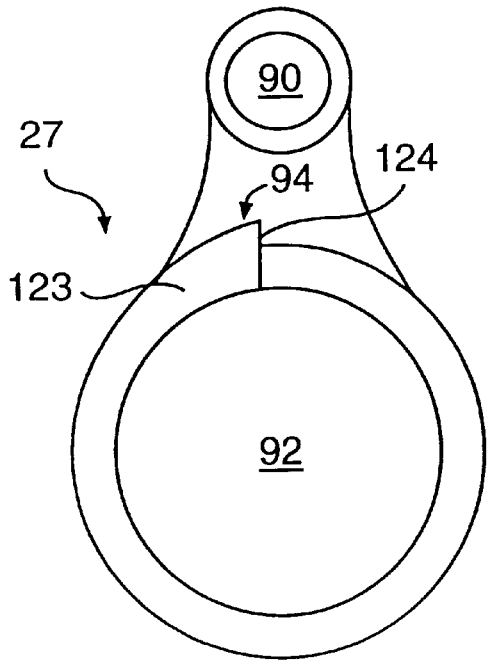
FIG. 6*b* is a front plan view of a second embodiment of a connecting rod.

The present invention contemplates that many variations of the first and second stop mechanisms will be readily apparent to one skilled in the art. For example, as illustrated in FIGS. 6*a* and 6*b*, eccentric cam 16 may include a projection 120 having a face 122. Connecting rod 27 may include a sloping projection 123 ending in a stop 124. When crankshaft 15 is rotated in the forward direction, projection 120 on eccentric cam will ride along and over sloping projection 120 on connecting rod 27. However, when the direction of crankshaft rotation is reversed, face 122 of eccentric cam will engage stop 124 on connecting rod 27, thereby preventing the eccentric cam from rotating with respect to the connecting rod.

Figure 7:
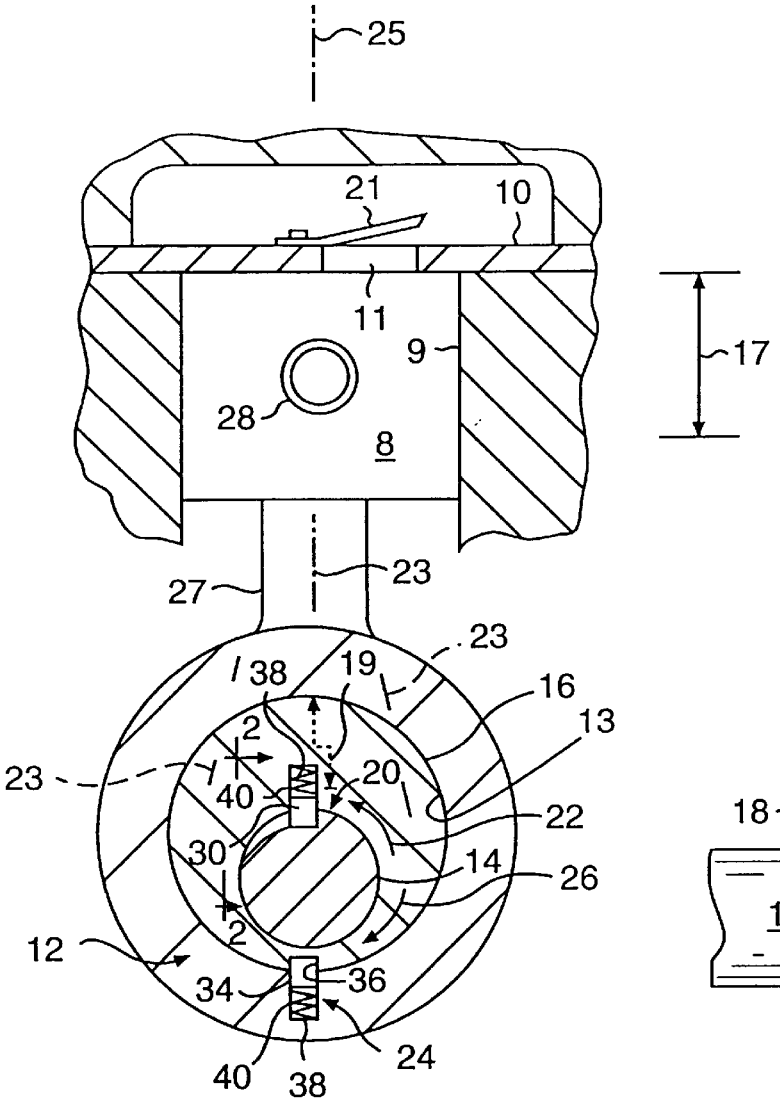
FIG. 7 is a partially cross-sectional view of portions of a refrigerant compressor.
Figure 8:
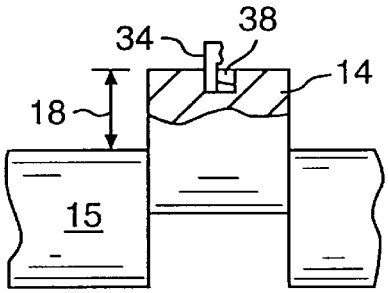
FIG. 8 is a view of a section of a crankshaft and a crankpin taken along line 2—2 in FIG. 7.

FIGS. 7 and 8 illustrate another exemplary embodiment of the first and second stop mechanisms. This embodiment of the coupling structure is generally designated 12 and is shown in connection with a refrigerator compressor having a piston 8 mounted in a cylinder 9, and having a reed type discharge valve 21 mounted on a valve plate 10 having a discharge port 11 therethrough. The first stop means 20 comprises cooperating shoulder means such as pin 30 on eccentric cam 16 and shoulder 32 machined into crankpin 14, and wherein said second stop means 24 comprises cooperating shoulder means such as pin 34 on connecting rod 27 and shoulder 36 machined into eccentric cam 16. The pins 30 and 34 are continually urged radially inwardly from their sockets 38 by compression springs 40.

Figure 9:
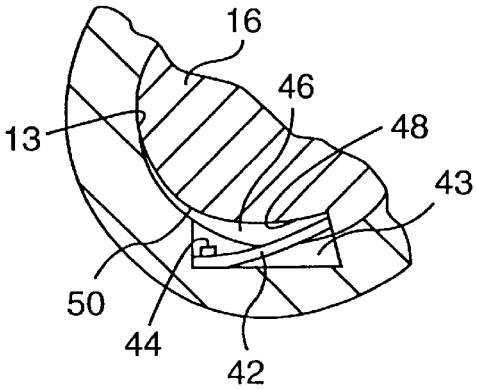
FIG. 9 is an enlarged view of a segment of FIG. 7 showing a variation in the stop mechanism structure.

As an alternative stop mechanism, as shown in FIG. 9, a leaf-type spring or equivalent structure 42 is affixed by screw 44 or the like in a slot 43 machined into connecting rod 27 and is normally sprung into slot 46 machined into eccentric cam 16. As eccentric cam 16 orbits counterclockwise, spring 42 is flexed radially outwardly in to slot 43. It is noted that spring 42 and slot 46 can be dimensioned such that the spring does not strike against the slot floor 48 upon each counterclockwise orbit of the crankpin and eccentric cam and create objectionable clicking sound. Also in this regard, the radius 50 of the exit from slot 46 further reduces or eliminates any noise created by contact of spring 42 with the eccentric cam. Such structure can also be used for the crankpin to eccentric cam junction.

Figure 11:
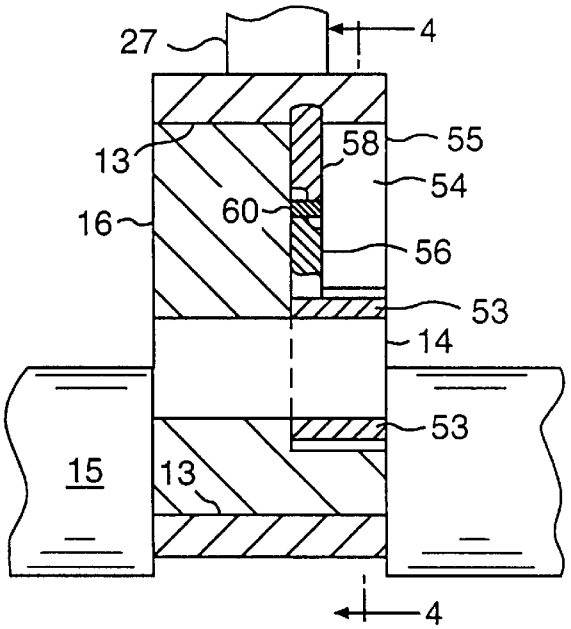
FIG. 11 is a cross sectional view taken along line 5—5 of FIG. 10 in the direction of the arrows and rotated 90° in the plane of the drawing sheet.
Figure 12:
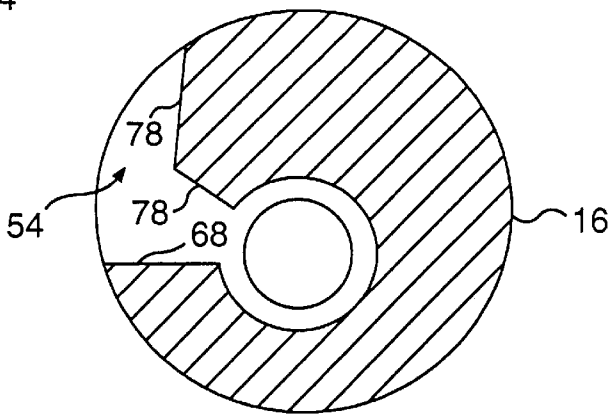
FIG. 12 is an isolated view of the cam bushing per se of FIG. 11.
Figure 10:
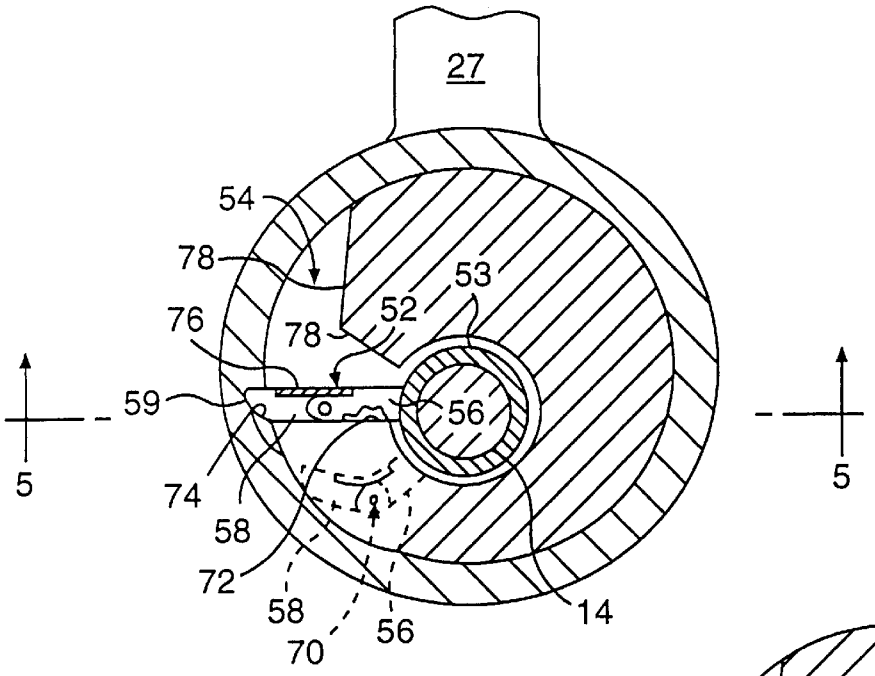
FIG. 10 is an enlarged view as in FIG. 7 taken along line 4—4 of FIG. 11 in the direction of the arrows and showing a variation in the stop mechanism.

Referring to FIGS. 10–12, a further variation of the stop structure is shown as being operable thru a break-down linkage which eliminates unnecessary contact of the stop with a rotating structure. In this embodiment as applied, for example, to the eccentric cam and connecting rod, a stop arm generally designated 52 is affixed to a sleeve 63 rotatably mounted on crankpin 14 within a recess 54 in a face 55 of eccentric cam 16. Arm 52 is comprised of an inner section 56 affixed to sleeve 53 and an outer stop section 58 providing a stop end 59. Sections 56 and 58 are pivotally connected by a hinge pin 60.

In the operation the stop mechanism of FIGS. 10–12 with the motor and crankshaft rotating in a clockwise direction for reduced stroke wherein only the crankpin will orbit clockwise, the crankpin will drag eccentric cam 16 also clockwise to engage its recess edge 68 with stop arm 52 and move it and straighten it from its dotted line neutral position 70 to its operative stopping position 72 as shown in FIG. 10 wherein end 59 is set into socket 74. This action locks the eccentric cam 16 to the connecting rod at the precise position that the eccentricity of eccentric cam 16 is aligned with the stroke axis 23 of the connecting rod to assure TDC. A light spring 76 affixed to the top of one of the sections 56 or 58 and slidable on the other may be used to urge section 58 downwardly (as viewed in the drawing) to assist in its insertion into socket 74. Other springs such as a torsional spring mounted over an extension of pivot pin 60 may also be used.

Reversal of the motor and crankshaft direction to a counterclockwise rotation for full stroke will forcibly rotate eccentric cam 16 to engage its recess edge 78 with arm 52 and break it down easily against the force of spring 76 as indicated by the dotted line positions 70 of arm sections 56 and 58 in FIG. 10. This action, at precisely said positions 70, will maintain alignment of the eccentricities of eccentric cam 16 and crankpin 14 in cooperation with the stop means which operatively connects crankpin 14 and eccentric cam 16 for simultaneous orbiting to ensure TDC.

It is noted that as crankpin 14 moves alone thru its orbit during reduced stroke the cam eccentricity 19 will be swung back and forth to each side of the piston stroke axis 25, but as indicated by the approximate dotted lines 23, the cam eccentricity will remain substantially aligned with the connecting rod axis 23.

It is apparent that the present invention in its broad sense is not limited to the use of any particular type of stop structure and the components of the stops shown herein can be reverse mounted, e.g., the spring 40 and pin 34 can be mounted in the cam bushing and the shoulder 36 cut into the bearing.

In the illustrated embodiments, the eccentricities of the eccentric cam and the crankpin are substantially equal whereby the cylinder capacity can be switched from full to substantially one half upon reversing the crankshaft rotation.

It is particularly noted that the first and second stop means or stop mechanisms may be positioned at any angular position around the crankpin and eccentric cam, and around the eccentric cam and connecting rod respectively as long as the two eccentricities are aligned for full stroke, and the bushing eccentricity is substantially aligned with the connecting rod stroke axis for the reduced stroke.

Figure 15A:
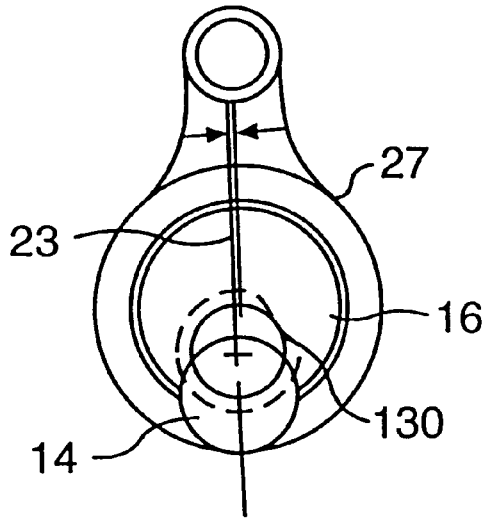
FIG. 15*a* is a front view of a mechanical system for linking a reversible motor to a piston, illustrating a stabilizing system when the compressor is operating in a full stroke mode.
Figure 15B:
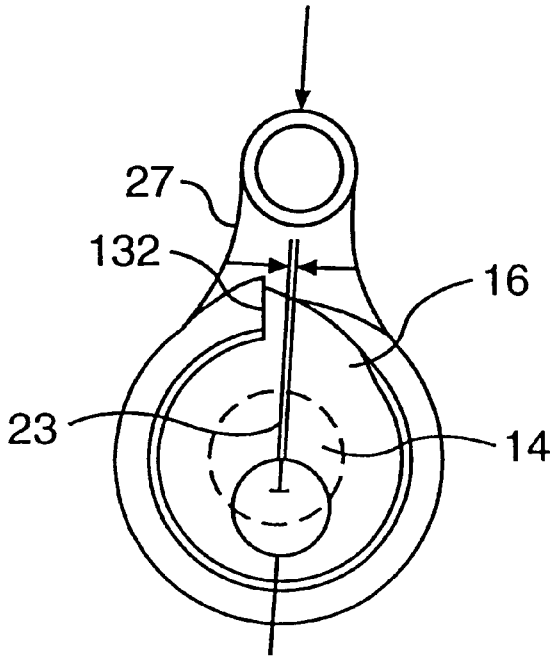
FIG. 15*b* is a rear view of a mechanical system for linking a reversible motor to a piston, illustrating a stabilizing system when the compressor is operating in a half stroke mode.

As shown in FIGS. 15*a* and 15*b*, first stop mechanism 130 and second stop mechanism 132 are preferably offset from connecting rod axis 23. When the crankshaft rotates in the forward direction to achieve the full stroke mode, first stop mechanism has a tendency to become unstable just after the piston passes top dead center. If first stop mechanism 130 is offset as shown in FIG. 15*a*, the forces that create the instability will act on eccentric cam 16 to move the eccentric cam into connection with the stop on the crankshaft, thereby removing the instability.

When the crankshaft rotates in the reverse direction and causes the piston to move through the half stroke, there is no tendency for the system to become unstable. However, during transients an instability could exist. Thus, second stop mechanism 132 is preferably advanced as shown in FIG. 15*b* to prevent any unstable conditions.

In accordance with the present invention, a unique electrical circuit has been developed for controlling the reversible motor and may be employed in a preferred embodiment of the invention as described below in connection with a single cylinder compressor, the circuit being shown schematically in FIGS. 16 and 17.

Figure 16:
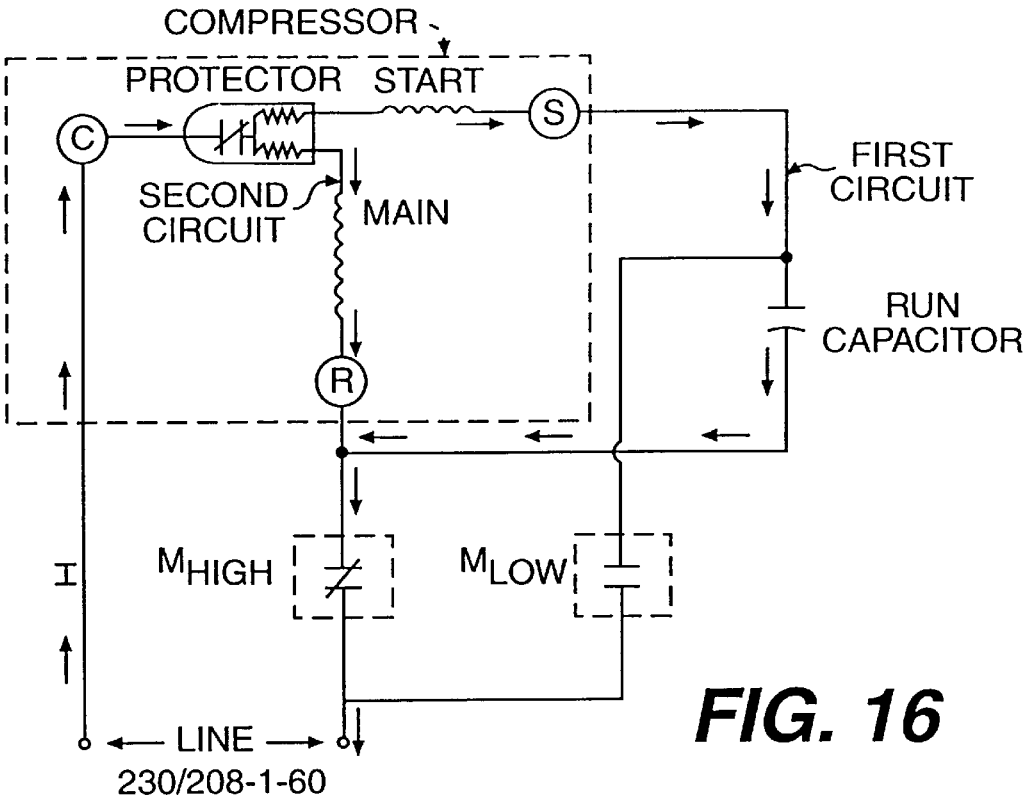
FIG. 16 is a motor control schematic for full capacity compressor operation.

The control schematic of FIG. 16 is equivalent to industry conventional PSC (permanent, split capacitor) wiring schematics using predetermined power supply. Line I runs through the common terminal (C) which leads into the motor protection. After leaving the motor protection, the current flow will split, going through both the start (S) and main, i.e., run (R) windings with M (motor) High contactor closed. This stage will be using the run winding as the main winding and places the run capacitor in series with the start winding, obtaining standard motor rotation with the piston fully active, i.e., full capacity operation.

Figure 17:
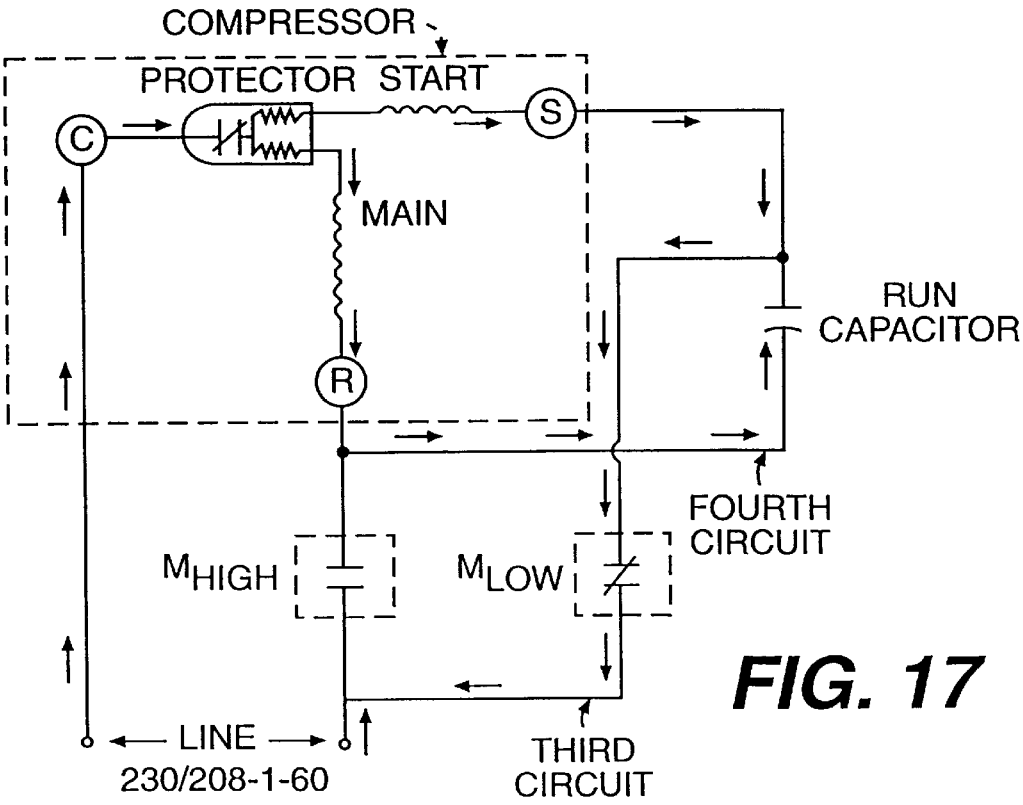
FIG. 17 is a motor control schematic for motor reversal and reduced capacity compressor operation.

The present unique Control Schematic of FIG. 17 employs a predetermined power supply depending on application. Line one will run through the common terminal (C), which leads to the motor protection. After leaving the motor protection, the current flow separates going through both the original start and original main windings with M low contactor energized. The compressor will now be using the start winding as the main and placing the run capacitor in series with the original main winding. Run capacitor placement in this mode facilitates both motor and mechanical rotation changes and simultaneously reduces motor strength to match the resulting reduced piston stroke, thus maximizing motor efficiency for the reduced load. It is particularly noted that for certain applications the original main winding and start capacitor, in reduced compressor capacity mode, may be taken off-line by a centrifugal switch or the like after the motor attains operational speed.

Suitable exemplary solenoid actuated contactors or switches for use as the "switching means" of the present invention are shown and described in the General Electric, Product information brochure GEA-115408 4/87 ISM 1800, entitled "Definite Purpose Controls", 23 pages, the disclosure of which is hereby incorporated herein by reference in its entirety.

As best known at this time for use with a single cylinder compressor described below, the power unit would employ the following structures and operating characteristics:

Motor—reversible, squirrel cage induction, PSC, 1–3 hp;

Protector—Protects against overload in both load modes. Senses both T° and current;

Run Capacitor - - - 35 $\mu$F/370 VAC;

Speed (rated load) - - - 3550 rpm;

Motor Strength - - - 252 oz. ft. Max/90 oz. ft. rated load;

Power Supply—Single or three phase of any frequency or voltage, e.g., 230V-60 $H_z$ single phase, or 460V—60 $H_z$ three phase;

Switching Mechanism—control circuit which is responsive to load requirements to operate solenoid contactor and place the run capacitor in series with either the start winding or main winding, depending on the load requirements.

The compressor would have substantially the following structure and operating characteristics:

(a) size (capacity) - - - 3 Ton;

(b) number of cylinders - - - One;

(c) cylinder displacement at full throw - - - 3.34 $in^3$/rev;

(d) full stroke length - - - 0.805 in.;

(e) normal operating pressure range in full stroke mode - - - 77 to 297 Psig.

Figure 18:
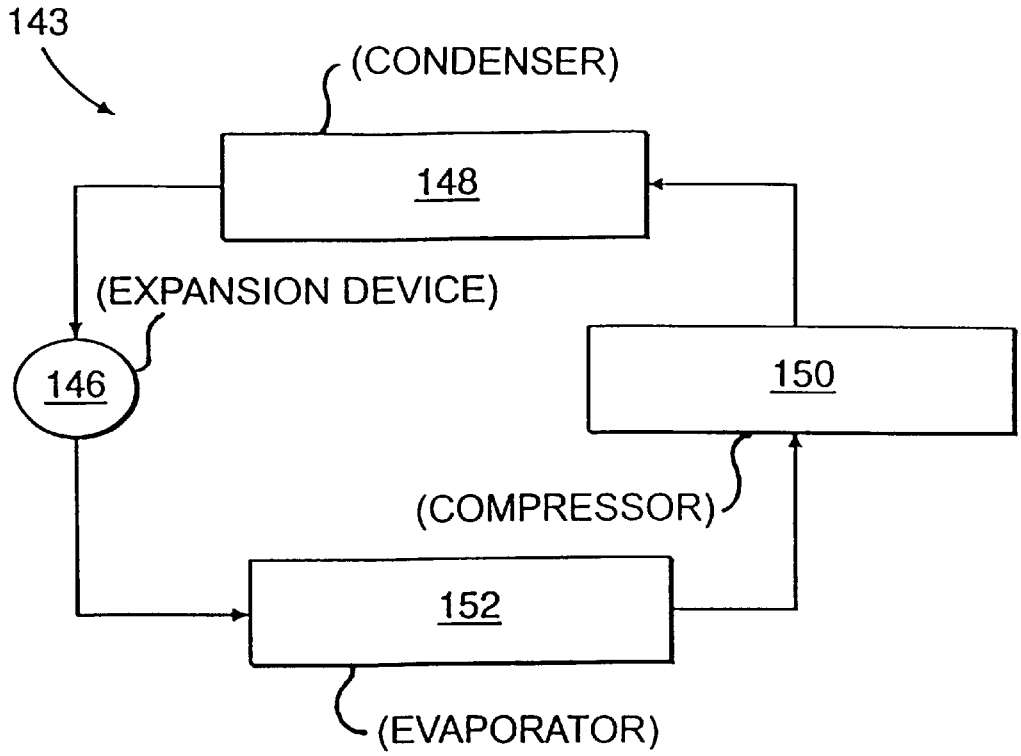
FIG. 18 is a schematic diagram of a refrigeration cycle.

In accordance with the present invention, the two stage reciprocating compressor and control system described above may be used in a variety of commercial applications utilizing a refrigeration cycle. An exemplary embodiment of a refrigeration cycle is illustrated in FIG. 18 and generally designated as reference number 143. As shown, refrigeration cycle 143 includes a condenser 148, an expansion device 146, an evaporator 152, and a two-stage reciprocating compressor 150. A refrigerant is circulated through the refrigeration cycle. As is known in the art, the capacity of compressor 150 directly affects the amount of cooling provided by the refrigerant in the evaporator. When the two stage reciprocating compressor is operated in the full stroke mode, compressor 150 operates at full capacity and provides maximum cooling to the evaporator. When the two stage reciprocating compressor is operated in the reduced stroke mode, the amount of cooling provided to the evaporator is similarly reduced.

Figure 19:
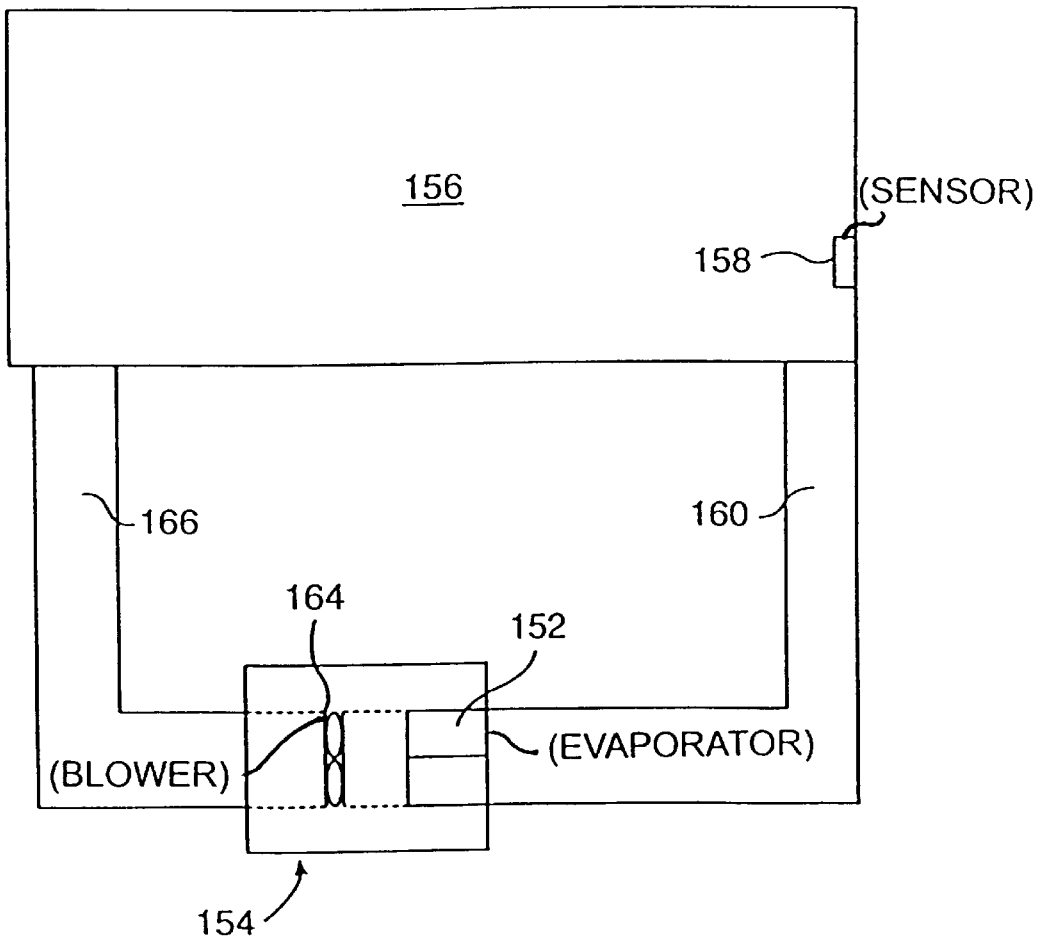
FIG. 19 is a schematic diagram of a heating, ventilating, and air conditioning ("HVAC") system.

It is contemplated that the two stage reciprocating compressor of the present invention may be used in a variety of commercial applications. For example, as illustrated in FIG. 19, refrigeration cycle 143 may be used in a heating, ventilating, and air conditioning ("HVAC") system. The HVAC system is used to condition the air in an enclosure 156. Air is circulated through the HVAC unit 154 through supply duct 160 and return duct 166 by a blower 164. Blower 164 passes air over the evaporator of the refrigeration cycle to cool the air before the air enters the room. A temperature sensor 158 is positioned within enclosure 156. When sensor 158 determines the temperature of enclosure has risen above a preset limit, sensor 158 activates the compressor in either the full stroke mode or the reduced stroke mode depending upon the sensed temperature of the air. Operating the compressor at the appropriate capacity depending upon the current conditions of the room will improve the overall efficiency of the system. It is contemplated that the present invention may be used in other air conditioning systems, such as heat pumps, or the like.

Figure 20:
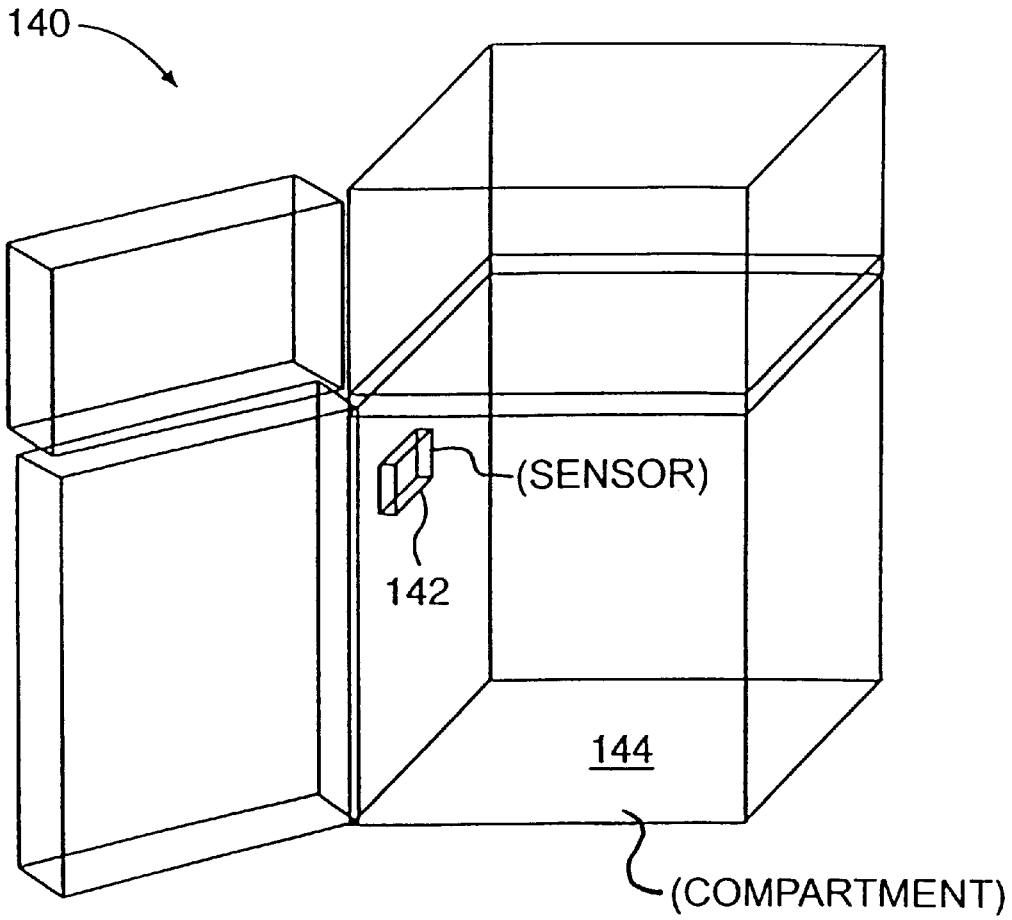
FIG. 20 is a perspective view of a refrigerator appliance.

The refrigeration cycle may also be used with a refrigerator appliance. As illustrated in FIG. 20, a refrigerator 140 includes at least one insulated cooling compartment 144. A temperature sensor 142 is positioned inside compartment 144. Depending on the temperature of compartment 144, the compressor may be operated in either the full stroke or reduced stroke mode. Preferably, the compressor is continuously operated in the reduced stroke mode until a high cooling demand, such as opening the door or introducing a load of relatively warm perishables, is placed on the refrigerator. When the high demand is sensed by sensor 142 by a rise in the temperature of compartment 144, the compressor may be switched to full stroke mode to compensate for the increased demand. In this manner, compartment 144 of refrigerator 140 may be kept cool efficiently and reliably.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A two stage reciprocating compressor comprising:

a block with a single cylinder and associated single compression chamber and single piston;

a reversible motor for rotating in a forward and a reverse direction;

a mechanical system between the motor and the single piston for driving the piston at a full stroke between a bottom position and a top dead center position when the motor is operated in the forward direction and for driving the piston at a reduced stroke between an intermediate position and the top dead center position when the motor is operated in the reverse direction; and a control for selectively operating said motor either in the forward direction at a first preselected, fixed speed or in the reverse direction at a second preselected, fixed speed.

2. The compressor of claim 1, wherein said mechanical system includes a crankshaft rotated by said motor, an eccentric crankpin formed on the crankshaft, an eccentric, two position cam rotatably mounted on the crankpin, and a connecting rod linking said cam to said piston, said cam rotating to and operating at a first position relative to said crankpin when the motor is rotating in the forward direction and rotating to and operating at a second position relative to said crankpin when the motor is rotating in the reverse direction, the eccentricities of said crankpin and said cam combining to cause the piston to have the full stroke when the motor is operated in the forward direction and to cause the piston to have the reduced stroke when the motor is operated in the reverse direction.

3. The compressor of claim 2, wherein said cam is slidably mounted on said crankpin and said cam slides axially along the crankpin when said cam rotates between the first operating position and the second operating position.

4. The compressor of claim 3, wherein said cam includes a first sloping projection having a first face and a second sloping projection having a second face, the first face configured to engage the crankshaft when the motor is operating in the forward direction and the second face configured to engage the connecting rod when the motor is operating in the reverse direction.

5. The compressor of claim 4, wherein said crankpin includes a stop and said connecting rod includes a stop, said first face engaging the stop of the crankpin to restrict the relative rotation of said cam about the crankshaft and said second face engaging the stop on the connecting rod to restrict the relative rotation of said cam within the connecting rod when the crankshaft rotates in the reverse direction.

6. The compressor of claim 5, further comprising a spring biasing said cam axially along the crankpin to align the first and second sloping projections of said cam with the stop of the crankpin and the stop of the connecting rod.

7. The compressor of claim 2, further comprising a first stop mechanism for restricting the relative rotation of said cam about said crankpin when the motor is running in the forward direction and a second stop mechanism for restricting the relative rotation of said cam with respect to said connecting rod when the motor is running in the reverse direction.

8. The compressor of claim 7, wherein said first stop mechanism comprises a stop on said crankshaft and a corresponding stop on said cam.

9. The compressor of claim 7, wherein said second stop mechanism comprises a stop on said crankshaft and a stop on said cam.

10. The compressor of claim 2, further comprising a first system for stabilizing the cam in the first position on the crankpin when the motor rotates in one direction and a second mechanism for stabilizing said cam in the second position on the connecting rod when the motor operates in the reverse direction.

11. The compressor of claim 2, wherein said motor includes:

first and second parallel circuits for operating the motor in the forward direction, said first circuit having a start winding in series with a capacitor and said second circuit having a run winding; and third and forth parallel circuits for operating the motor in the reverse direction, said third circuit having said start winding and said forth circuit having said run windings in series with said capacitor.

12. The compressor of claim 11, wherein said control includes a switch responsive to load requirements for placing said first and second circuits on line for higher loads and for switching to said third and forth circuits for lighter loads.

13. The compressor of claim 2, wherein the eccentricities of said cam and said crankpin are chosen so that the capacity of the compressor is switched from full to approximately one half, upon reversing of the motor.

* * * * *

UNITED STATES PATENT AND TRADEMARK OFFICE

CERTIFICATE OF CORRECTION

PATENT NO. : 6,217,287 B1
DATED : April 17, 2001
INVENTOR(S) : Monk et al.

It is certified that error appears in the above-identified patent and that said Letters Patent is hereby corrected as shown below:

Column 12, claim 11,
Lines 34 and 36, "forth" should read -- fourth --.

Column 12, claim 12,
Line 41, "forth" should read -- fourth --.

Signed and Sealed this

Sixth Day of November, 2001

*Attest:*

Nicholas P. Godici

*Attesting Officer*

NICHOLAS P. GODICI
*Acting Director of the United States Patent and Trademark Office*